US005774158A

United States Patent [19]

Desie et al.

[11] Patent Number: 5,774,158

[45] Date of Patent: Jun. 30, 1998

[54] DEVICE FOR DIRECT ELECTROSTATIC PRINTING (DEP) COMPRISING ROWS OF SMALLER AND LARGER SIZED APPARATUS

[75] Inventors: Guido Desie, Herent; Marc Van Ostaeyen, Ranst, both of Belgium

[73] Assignee: Agfa-Gevaert, N.V., Mortsel, Belgium

[21] Appl. No.: 551,674

[22] Filed: Nov. 1, 1995

[30] Foreign Application Priority Data

Nov. 4, 1994 [EP] European Pat. Off. ..... 94203221

[51] Int. Cl.[6] ..... B41J 2/39; B41J 2/395; B41J 2/385; G03G 9/08

[52] U.S. Cl. ..... 347/141; 347/103; 347/55; 347/154; 347/158; 347/124; 347/141

[58] Field of Search ..... 347/103, 114, 347/151, 154, 55, 115, 158, 124, 141; 399/178, 374, 55, 184, 278

[56] References Cited

U.S. PATENT DOCUMENTS

| | | | |
|---|---|---|---|
| 3,689,935 | 9/1972 | Pressman et al. | 347/55 |
| 4,860,036 | 8/1989 | Schmidlin | 347/55 |
| 5,353,105 | 10/1994 | Gundlach et al. | 347/151 |

FOREIGN PATENT DOCUMENTS

A0634862 1/1995 European Pat. Off. .

OTHER PUBLICATIONS

Patent Abstracts of Japan, vol. 7, No. 177 (M–233) (1322), Aug. 5, 1983 and JP–A–58 081 177 (Canon) May 16, 1983.

Patent Abstracts of Japan, vol. 9, No. 121 (M–382) (1844) May 25, 1985 and JP–A–60 006 477 (Nippon Denshin Denwa Kosha) Jan. 14, 1985.

Patent Abstracts of Japan, vol. 9, No. 297, (M–432) (2020), Nov. 25, 1985 and JP–A–60 135 266 (Nippon Denshin Denwa Kosha) Jul. 18, 1985.

*Primary Examiner*—Benjamin R. Fuller
*Assistant Examiner*—Raquel Yvette Gordon
*Attorney, Agent, or Firm*—Baker & Botts, L.L.P.

[57] ABSTRACT

A device for use in the technique of direct electrostatic printing (DEP) on an intermediate or final substrate is described, comprising:

a receiving member support 5 a printhead structure 6 having control electrodes 6*a* on its back side, in combination with apertures 7 and at least one common shield electrode 6*b* on the front side ;

a toner delivery means 1 presenting a cloud 4 of toner particles in the vicinity of the apertures 7.

The printhead structure 6 is made of a plastic isolating substrate, and has at least two rows of apertures. Preferentially each row has one common shield electrode (6*b*, 6*c*) at the front side of the printhead structure. The individual control electrodes on the back side are galvanically isolated per aperture from each other and from each shield electrode. The control electrodes are arranged around the apertures. The size or diameter of the apertures of one row is substantially different from the size of the apertures of a second row. This arrangement allows a high quality reproduction of continuous tone images, along with crisp graphics and characters by one single printing pass.

10 Claims, 2 Drawing Sheets

DEVICE FOR DIRECT ELECTROSTATIC PRINTING (DEP) COMPRISING ROWS OF SMALLER AND LARGER SIZED APPARATUS

FIELD OF THE INVENTION

This invention relates to an apparatus used in the process of electrostatic printing and more particularly in Direct Electrostatic Printing (DEP). In DEP, electrostatic printing is performed directly from a toner delivery means on a receiving member substrate by means of an electronically addressable printhead structure and the toner has to fly in an imagewise manner towards the receiving member substrate.

BACKGROUND OF THE INVENTION

In DEP (Direct Electrostatic Printing) the toner or developing material is deposited directly in an imagewise way on a receiving member substrate, the latter not bearing any imagewise latent electrostatic image. The substrate can be an intermediate endless flexible belt (e.g. aluminium, polyimide etc.). In that case the imagewise deposited toner must be transferred onto another final substrate. Preferentially the toner is deposited directly on the final receiving member substrate, thus offering a possibility to create directly the image on the final receiving member substrate, e.g. plain paper, transparency, etc. This deposition step is followed by a final fusing step.

This makes the method different from classical electrography, in which a latent electrostatic image on a charge retentive surface is Further on, either the powder image is fused directly to said charge retentive surface, which then results in a direct electrographic print, or the powder image is subsequently transferred to the final substrate and then fused to that medium. The latter process results in an indirect electrographic print. The final substrate may be a transparent medium, opaque polymeric film, paper, etc.

DEP is also markedly different from electrophotography in which an additional step and additional member is introduced to create the latent electrostatic image. More specifically, a photoconductor is used and a charging/exposure cycle is necessary.

A DEP device is disclosed by Pressman in U.S. Pat. No. 3,689,935. This document discloses an electrostatic line printer having a multi-layered particle modulator or printhead structure comprising:

a layer of insulating material, called isolation layer;

a shield electrode consisting of a continuous layer of conductive material on one side of the isolation layer;

a plurality of control electrodes formed by a segmented layer of conductive material on the other side of the isolation layer; and at least one row of apertures.

Each control electrode is formed around one aperture and is isolated from each other control electrode.

Selected potentials are applied to each of the control electrodes while a fixed potential is applied to the shield electrode. An overall applied propulsion field between a toner delivery means and a receiving member support projects charged toner particles through a row of apertures of the printhead structure. The intensity of the particle stream is modulated according to the pattern of potentials applied to the control electrodes. The modulated stream of charged particles impinges upon a receiving member substrate, interposed in the modulated particle stream. The receiving member substrate is transported in a direction orthogonal to the printhead structure, to provide a line-by-line scan printing. The shield electrode may face the toner delivery means and the control electrode may face the receiving member substrate. A DC field is applied between the printhead structure and a single back electrode on the receiving member support. This propulsion field is responsible for the attraction of toner to the receiving member substrate that is placed between the printhead structure and the back electrode.

The varying densities within the printed image can be obtained by modulation of the voltage applied to the individual control electrodes. In most DEP systems, either small density variations are difficult to reproduce consistently or the spatial resolution is too low to achieve crisp graphics. This poses a problem when graphics and image data must be combined on one receiving member substrate. Graphics, such as text or line art, demand for a high spatial resolution but have usually a bilevel character, i.e. no specific density resolution is required. The reproduction of continuous tone images on the other hand requires from the reproduction system multilevel capabilities, which is equivalent to a higher degree of density resolution.

It has been suggested in the past to combine a DEP device in one apparatus together with a classical electrographic or electrophotographic device, in which a latent electrostatic image on a charge retentive surface is developed by a suitable material to make the latent image visible. In such an apparatus, the DEP device and the classical electrographic device are two different printing devices. Both may print images with various grey levels and alphanumeric symbols and/or lines on one sheet or substrate. In such an apparatus the DEP device can be used to print fine tuned grey levels (e.g. pictures, photographs, medical images etc. that contain fine grey levels) and the classical electrographic device can be used to print alphanumeric symbols, line work etc. Such graphics do not need the fine tuning of grey levels. In such an apparatus—combining a DEP device with a classical electrographic device—the strengths of both printing methods are combined. The complexity of the combined device is however an important drawback.

There is thus a need for a simple DEP system, yielding high quality reproductions of continuous tone images along with sharp text and graphics quality.

SUMMARY OF THE INVENTION

It is an object of the invention to provide an improved Direct Electrostatic Printing (DEP) device, printing high quality continuous tone images in combination with high quality graphics.

It is a further object of the invention to provide a DEP device combining high density resolution with high spatial resolution, enabling smooth pictures and sharp edges respectively.

Further objects and advantages of the invention will become clear from the description hereinafter.

The above objects are realized by an apparatus and methods for direct electrostatic printing. In accordance with the present invention, the apparatus includes: a printhead structure having a plurality of first apertures, a plurality of second apertures, the first apertures being at least 50% larger in area than the second apertures, and a plurality of control electrodes on a back side of the printhead structure, an individual one of the control electrodes arranged around each of the first and second apertures; and a toner delivery means facing a front side of the printhead structure for delivering toner particles to the first and second apertures.

In accordance with the present invention, a method for direct electrostatic printing includes the steps of: generating multi-level bitmap signals for driving a plurality of control electrodes arranged around a plurality of first and second apertures, the first apertures being at least 50% larger in area than the second apertures, and the multi-level bitmap signals representing a plurality of device pixels, each of the multi-level bitmap signals having more than two levels for each of the device pixels; analyzing neighboring bitmap signals; generating high resolution and low resolution signals depending upon variations between the neighboring bitmap signals; driving the control electrodes arranged around each of the first apertures with the low resolution signals, an individual one of the control electrodes arranged around each of the first apertures; driving the control electrodes arranged around each of the second apertures with the high resolution signals, an individual one of the control electrodes arranged around each of the second apertures; and transmitting toner from a toner delivery means through the first and second apertures directly onto a receiving member substrate.

In further accordance with the present invention, another method for direct electrostatic printing comprises the steps of: generating high resolution and low resolution bitmap signals for driving a plurality of control electrodes arranged around a plurality of first and second apertures, the first apertures being at least 50% larger in area than the second apertures; driving the control electrodes arranged around each of the first apertures with the low resolution signals, an individual one of the control electrodes arranged around each of the first apertures; driving the control electrodes arranged around each of the second apertures with the high resolution signals, an individual one of the control electrodes arranged around each of the second apertures; and transmitting toner from a toner delivery means through the first and second apertures directly onto the receiving member substrate.

DETAILED DESCRIPTION OF THE INVENTION

Figure 1:
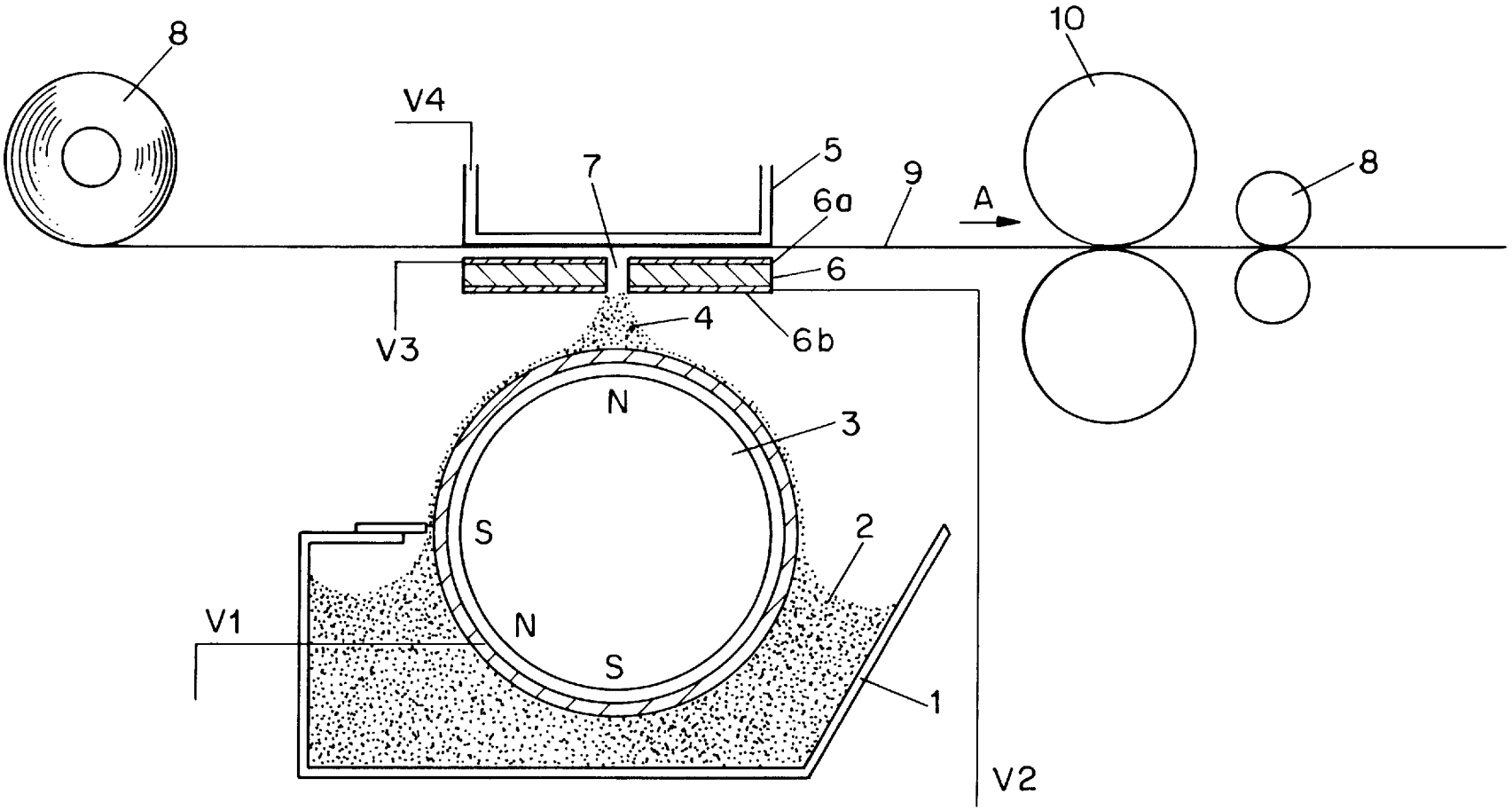
FIG. 1 is a schematic illustration of a possible embodiment of a DEP device according to the present invention.

In the literature many devices have been described that operate according to the principles of DEP (Direct Electrographic Printing). All these devices are able to perform grey scale printing either by voltage modulation or by time modulation of the voltages applied to the control electrodes. We have found that if voltage amplitude or time modulation is applied to the control electrode of an aperture with a larger diameter, a more continuous tone scale, than if a smaller diameter is used, can be achieved. Therefore, it is advantageous to use apertures with larger diameter values. This however restricts the spatial resolution. A high density resolution over a wide density range can be achieved only by a printhead structure having rather large apertures. By high density resolution is meant the capability to reproduce in a consistent way densities resolution will be able to reproduce a large amount of different density levels within a fixed density range. On the other hand, large apertures have a negative effect on the spatial resolution. The spatial resolution is related to the number of pixels per unit of length that can be addressed individually to achieve a specific density. If the aperture diameter is made very small such that the apertures can be arranged closer to each other, in order to achieve a higher spatial resolution, the achievable density resolution is negatively influenced. For that reason a good compromise between grey scale tone or density resolution and spatial resolution has to be chosen if a printhead structure with only one aperture diameter is used.

We have found that the combination of at least two aperture diameters in a single printhead structure not only makes it possible to combine both advantages of apertures having a small diameter and large diameter, but even yields synergetic effects because the apertures having a small diameter can advantageously be used to enhance the line sharpness in photo-quality printouts, leading to images having enhanced sharp edges. In order to achieve both effects, the larger apertures must have a substantially different size from the smaller apertures. This means that the area of the larger apertures must be at least 50% larger than the area of the smaller apertures. Preferentially, the diameter of the larger apertures is about twice as large as the diameter of the smaller apertures.

DESCRIPTION OF THE DEP DEVICE

A device for implementing DEP according to one embodiment of the present invention comprises (FIG. 1) :

(i) a toner delivery means 1, comprising a container for developer 2 and a magnetic brush assembly 3, this magnetic brush assembly forming a toner cloud 4.

(ii) a receiving member support 5, for guiding the receiving member substrate at a close distance from the printhead structure 6.

(iii) conveyer means 8 to convey a member receptive for said toner image—called receiving member substrate 9—between a printhead structure 6 and said receiving member support 5 in the direction indicated by arrow A.

(iv) means for fixing 10 said toner onto said image receiving member substrate 9.

Figure 2:
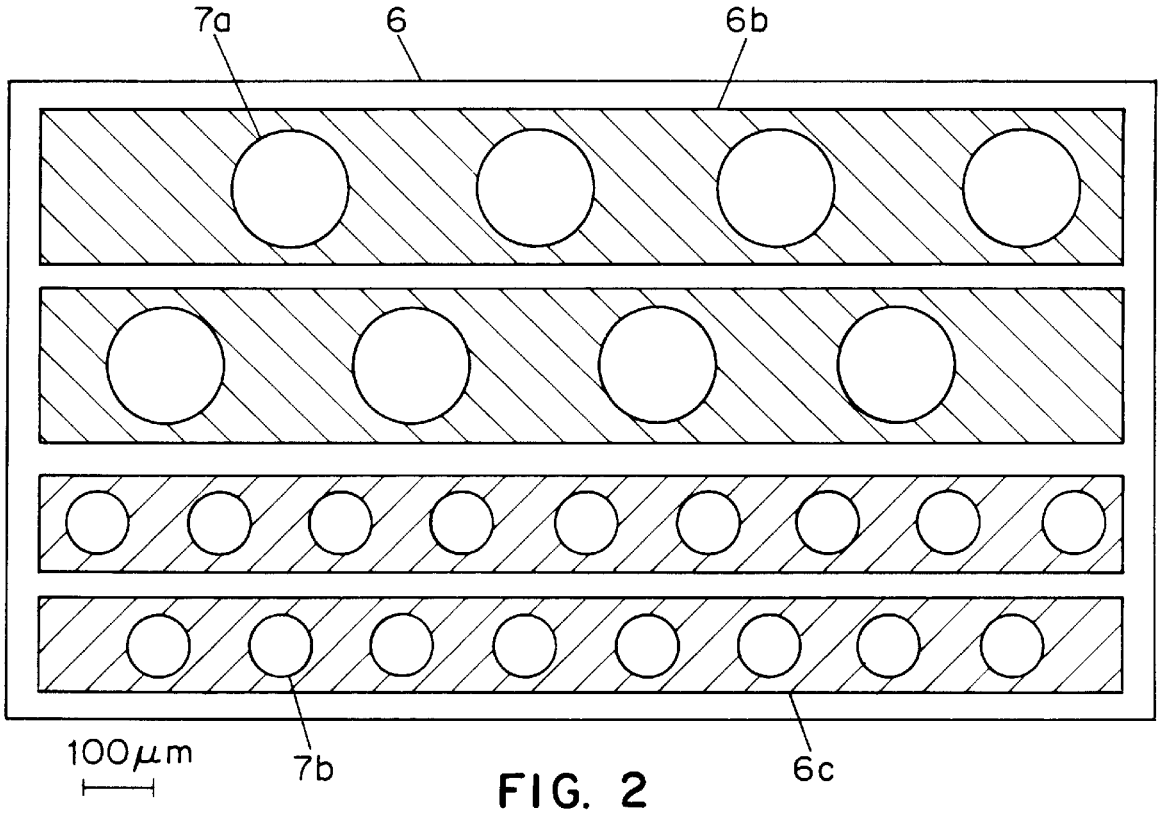
FIG. 2 is a schematic representation of one side of a printhead structure according to the present invention.

(v) a printhead structure 6, made from a plastic insulating film, comprising at least two rows of apertures 7*a* and 7*b*. As shown in FIG. 2, preferentially each row of apertures 7*a*, 7*b* has one linewise shield electrode 6*b*, 6*c*, on the front side of the printhead structure 6. This linewise shield electrode preferentially covers a substantial portion of a rectangular area enveloping the row of apertures, without covering the apertures. Preferentially the individual linewise shield electrodes are galvanically isolated from each other. The voltage applied to a linewise electrode corresponding to larger apertures may be substantially different from the voltage applied to a linewise electrode corresponding to smaller apertures, while the electrical propulsion field for toner particles depends on the size of the apertures, even if the voltages applied to the different electrodes are the same. The linewise electrode can also compensate for the difference in distance between the row of apertures and the toner delivery means.

Alternatively, the whole front side of the printhead structure is covered by one conductive layer or shield electrode. This makes the construction of the printhead structure simpler, at the cost of less degrees of freedom for voltage control of the individual rows.

Figure 3:
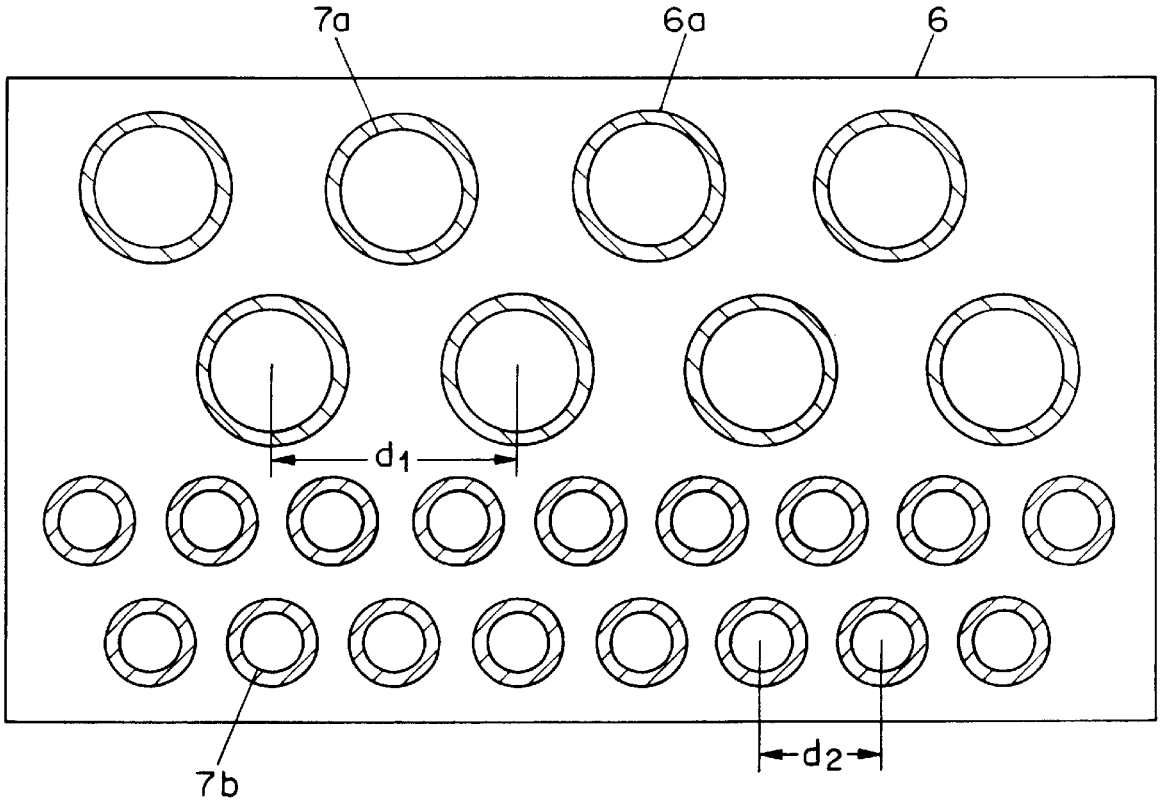
FIG. 3 is a schematic representation of the other side of the printhead structure in FIG. 2.

As shown in FIG. 3, each aperture 7*a* or 7*b* has one control electrode 6*a* arranged around one aperture on the back side of the printhead structure 6. Each control electrode is preferentially galvanically isolated from each other control electrode. The linewise shield electrodes are preferentially also galvanically isolated from the control electrodes. Alternatively, the printhead structure can be flipped, such that the front side becomes the back side and vice versa. Preferentially a first row consists of apertures 7*a* having a larger size—or diameter in the case that the apertures have a round shape—and a second row consists of apertures 7*b* having a smaller size. Because of the smaller diameter of the smaller sized apertures 7*b,* these can be arranged at a closer distance or pitch $d_2$ from each other than the distance $d_1$ between the centres of neighbouring larger sized apertures 7*a*. The smaller distance enables a higher spatial resolution of the printed pixels, usually expressed in pixels per inch. Both the linewise shield electrodes and the individual control electrodes may be constructed from a metallic film coating.

Although in FIG. 1 a preferred embodiment of a DEP device—using control electrodes 6*a* and linewise shield electrodes 6*b* on printhead structure 6—is shown, it is possible to realise a DEP device according to the present invention using different constructions of the printhead structure 6. It is e.g. possible to provide a device having a printhead structure comprising only one control electrode structure 6*a* as well as more than two electrode structures (6*a,* 6*b,* 6*c* and more). The apertures in these printhead structures can have a constant diameter, or can have a larger entry or exit diameter. It is also possible to provide the receiving member support 5 with a continuous back electrode, covering a substantial portion of the receiving member support. This back electrode can be set to a fixed voltage to permanently increase the attraction of toner particles by an electrical field through the receiving member substrate. The receiving member support can also be equipped with individual back electrodes, mutually galvanically isolated from each other and arranged in a one to one relation with the individual apertures. As such, the amount of toner per aperture resulting in a specific density per pixel—can be further modulated, not only by the control electrode in the printhead structure, but also by the back electrode in the receiving member support. Alternatively, individual isolated wires, parallel to the rows of apertures, can be arranged on the receiving member support 5. A receiving member support having both a common back electrode and a back electrode structure—comprising individual electrodes or electrode wires—gives even more advantages in the control of the density for individual pixels on the receiving member substrate.

In a specific embodiment of a DEP device, according to the present invention, shown in FIG. 1, voltage $V_1$ is applied to the sleeve of the magnetic brush assembly 3, a voltage $V_2$ to the linewise shield electrode 6*b*; and variable voltages $V_3$ ranging from $V_{30}$ up to $V_{3n}$ for the individual control electrodes 6*a*. Herein is $V_{30}$ the lowest voltage level applied to the control electrode, and $V_{3n}$ the highest voltage applied to said electrode. Usually a selected set of discrete voltage levels $V_{30}$, $V_{31}$, . . . can be applied to the control electrode. The value of the variable voltage $V_3$ is selected between the values $V_{30}$ and $V_{3n}$ from the set, according to the digital value of the image forming signals, representing the desired grey levels. Alternatively, the voltage can be modulated on a time basis according to the grey-level value. Voltage $V_4$ is applied to the receiving member support 5 behind the toner receiving member.

In a DEP device according to a preferred embodiment of the present invention, said toner delivery means 1 creates a layer of multi-component developer on a magnetic brush assembly 3, and the toner cloud 4 is directly extracted from said magnetic brush assembly 3. In other systems known in the art, the toner is first applied to a conveyer belt and transported on this belt in the vicinity of the apertures. A device according to the present invention is also operative with a mono-component developer or toner, which is transported in the vicinity of the apertures 7*a,* 7*b* via a conveyer for charged toner. Such a conveyer can be a moving belt or a fixed belt. The latter comprises an electrode structure generating a corresponding electrostatic travelling wave pattern for moving the toner particles.

The magnetic brush assembly 3 preferentially used in a DEP device according to an embodiment of the present invention can be either of the type with stationary core and rotating sleeve or of the type with rotating core and rotating or stationary sleeve.

Several types of carrier particles, such as described in EP-A-675417 can be used in a preferred embodiment of the present invention.

Also toner particles suitable for use in the present invention are described in the above mentioned European patent application.

A DEP device making use of the above mentioned marking toner particles can be addressed in a way that enables it to give black and white. It can thus be operated in a "binary way", useful for black and white text and graphics and useful for classical bilevel halftoning to render continuous tone images.

A DEP device according to the present invention is especially suited for rendering an image with a plurality of grey levels. Grey level printing can be controlled by either an amplitude modulation of the voltage $V_3$ applied on the control electrode 6*a* or by a time modulation of $V_3$. By changing the duty cycle of the time modulation at a specific frequency, it is possible to print accurately fine differences in grey levels. It is also possible to control the grey level printing by a combination of an amplitude modulation and a time modulation of the voltage $V_3$, applied on the control electrode.

The combination of a high spatial resolution, obtained by the small-diameter apertures 7*b,* and of the multiple grey level capabilities, obtained mainly from the larger-diameter apertures 7*a,* opens the way for multilevel halftoning techniques, such as e.g. described in EP-A-634862. This enables the DEP device, according to the present invention, to render high quality images.

The configuration with larger and smaller apertures can be exploited by the following methods. In a first method, one multilevel bitmap is created at a fixed resolution and when the bitmap signals are driving the control electrodes, a local grey level analysis of the bitmap data is performed, in order to establish which apertures are preferentially used to supply toner to the receiving member substrate. In a second method, two different bitmaps are established, a first one for high spatial resolution data and a second one for high density resolution data. The first bitmap signals drive the control electrodes 6*a* around the smaller apertures 7*b,* while the second bitmap signals drive the control electrodes 6*a* around the larger apertures 7*a*.

According to the first method, a bitmap is created, representing the image to be reproduced on the receiving member substrate. Usually, this image is created on an interactive workstation by a page layout program. After all elements for the image are gathered—including continuous tone images, graphical data and text—the page layout program generates a data stream in a page description language (PDL). A useful PDL is AgfaScript (a trade mark of Agfa-Gevaert A.G. in Leverkusen, Germany). A raster image processor converts the PDL data stream in a bitmap, by techniques known in the art. Dependent on the grey level capabilities of the device on which the image must be reproduced, the smallest entity of the bitmap—corresponding to a device pixel—occupies one or more bits. For a bilevel device, in which each pixel can be black or white, each device pixel requires one bit in the bitmap. For a device having e.g. sixteen possible grey levels, each device pixel requires four bits. A device offering 256 different grey levels, requires eight bits per pixel. In a preferred method, the PDL data stream is converted to a bitmap having minimum four and maximum eight bits per device pixel. The bitmap signals can be generated and stored in random access memory means (RAM) or on hard disk, until all signals for the full page are present. Then these bitmap signals can be sent to the electronic drivers, converting the digital signals to analog varying voltages or time modulated voltages on the control electrodes. If one row of large apertures 7*a* is present along with one row of small apertures, each spot on the receiving member substrate can be imaged by two differently sized neighbouring apertures. Consequently, it must be decided which control electrodes must be driven. In a preferred embodiment, the size and the pitch of the larger apertures 7*a* is twice as large as the size and pitch of the smaller apertures 7*b*. Therefore, each device pixel formed by a large aperture 7*a* covers four device pixels formed by small apertures. Before the bitmap signals are sent to the electronic drivers, the four bitmap signals corresponding to one large aperture are analyzed. If their grey-level values have a small variation, or the maximum grey level is close to the minimum grey level, then these signals belong to a smooth varying or even constant grey-level area. Such an area is preferentially reproduced by a large aperture 7*a*. The value for the driving voltage is preferentially determined by the mean value of the four bitmap signal values. On the other hand, if there is a high variation on these four bitmap signal values, then a sharp transition is present and preferentially this is represented by device pixels having a high spatial resolution. The four individual bitmap signals thus drive the control electrodes 6*a* corresponding to small apertures 7*b*.

According to the second method, the raster image processor must generate two bitmaps. The first bitmap may have a high spatial resolution, corresponding to the small pitch of the small sized apertures 7*b*. The grey scale resolution can be low, e.g. one to four bits per device pixel. The second bitmap may have a smaller spatial resolution, corresponding to the larger pitch of the large apertures 7*a*, but the grey scale resolution must be at least two times, preferentially four times higher than the grey scale resolution of the first bitmap. The raster image processor, analysing the data stream in a page description language, must decide to which bitmap the data must be transmitted. Text and black-and white graphics will go to the first bitmap. Continuous tone images will go to the second bitmap. If however "graphics" must be reproduced comprising slowly varying grey shades or synthetic images, the corresponding signals are preferentially sent to the second bitmap. On the other hand, if sharp edges are present in the continuous tone images, the data according to a neighbourhood of these edges are preferentially sent to the first bitmap. Once both bitmaps contain the data representing a page, the signals of both the first and second bitmap are sent quasi simultaneously to the drivers for the control electrodes around the small and large apertures respectively. That way, the sharp transitions will be imaged—at a higher density resolution—by the larger apertures.

EXAMPLE

A printhead structure 6 was made from a polyimide film of 100 $\mu$m thickness, double sided coated with a 15 $\mu$m thick copperfilm. The printhead structure 6 had four rows of apertures. On the back side of the printhead structure, facing the receiving member substrate, a ring shaped control electrode 6*a* was arranged around each aperture. Each of said control electrodes was individually addressable from a high voltage power supply. On the front side of the printhead structure, facing the toner delivery means, a common shield electrode was present. The apertures in two of said four rows had an aperture diameter of 170 micron, while the apertures in the other two rows had an aperture diameter of 85 micron. The pitch $d_1$ in the row with large apertures was 340 $\mu$m, the pitch $d_2$ in the row with small apertures was 170 $\mu$m. The width of the copper ring electrodes was 20 $\mu$m. Two rows of small apertures were staggered over 85 $\mu$m with respect to each other. This means that the centres of the apertures of the second row were shifted over a distance of 85 $\mu$m with respect to the first row. Two rows of large apertures were staggered over 170 $\mu$m with respect to each other. The large apertures were staggered with respect to the small apertures over a distance of 42.5 $\mu$m. This arrangement enables full coverage with toner of the receiving member substrate at all locations. It also gives a possibility to enhance the edges of a pixel written by a large aperture, by toner transmitted through the closest smaller apertures. Toner can thus be transmitted simultaneously through the smaller and larger apertures. On the other hand, toner—at a location on the receiving member substrate, corresponding to a large aperture—can be originated from said large aperture and neighbouring smaller apertures.

The toner delivery means 1 was a stationary core/rotating sleeve type magnetic brush comprising two mixing rods and one metering roller. One rod was used to transport the developer through the unit, the other one to mix toner with developer.

The magnetic brush assembly 3 was constituted of the so called magnetic roller, which in this case contained inside the roller assembly a stationary magnetic core, showing nine magnetic poles of 500 Gauss magnetic field intensity and with an open position to enable used developer to fall off from the magnetic roller. The magnetic roller contained also a sleeve, fitting around said stationary magnetic core, and giving to the magnetic brush assembly an overall diameter of 20 mm. The sleeve was made of stainless steel roughened with a fine grain to assist in transport (<50 $\mu$m). A scraper blade was used to force developer to leave the magnetic roller. And on the other side a doctoring blade was used to meter a small amount of developer onto the surface of said magnetic brush assembly. The sleeve was rotating at 100 rpm, the internal elements rotating at such a speed as to conform to a good internal transport within the development unit. The magnetic brush assembly 3 was connected to an AC power supply with a square wave oscillating field of 600 V at a frequency of 3.0 kHz with 0 V DC-offset.

A macroscopic "soft" ferrite carrier consisting of a MgZn-ferrite with average particle size 50 $\mu$m, a magnetisation at saturation of 29 emu/g was provided with a 1 $\mu$m thick acrylic coating. The material showed virtually no remanence.

The toner used for the experiment had the following composition : 97 parts of a co-polyester resin of fumaric acid and propoxylated bisphenol A, having an acid value of 18 and volume resistivity of $5.1\times10^{16}$ ohm.cm was melt-blended for 30 minutes at 110° C. in a laboratory kneader with 3 parts of Cu-phthalocyanine pigment (Colour Index PB 15:3). A resistivity decreasing substance—having the following structural formula : $(CH_3)_3NC_{16}H_{33}Br$—was added in a quantity of 0.5% with respect to the binder. It was found that—by mixing with 5% of said ammonium salt—the volume resistivity of the applied binder resin was lowered to $5\times10^{14}$ Ω.cm. This proves a high resistivity decreasing capacity (reduction factor :100).

After cooling, the solidified mass was pulverized and milled using an ALPINE Fliessbettgegenstrahlmühle type 100AFG (tradename) and further classified using an ALPINE multiplex zig-zag classifier type 100MZR (tradename). The resulting particle size distribution of the separated toner, measured by Coulter Counter model Multisizer (tradename), was found to be 6.3 μm average by number and 8.2 μm average by volume. In order to improve the flowability of the toner mass, the toner particles were mixed with 0.5% of hydrophobic colloidal silica particles (BET-value 130 $m^2/g$).

An electrostatographic developer was prepared by mixing said mixture of toner particles and colloidal silica in a 4% ratio (w/w) with carrier particles. The tribo-electric charging of the toner-carrier mixture was performed by mixing said mixture in a standard tumbling set-up for 10 min. The developer mixture was run in the development unit (magnetic brush assembly) for 5 minutes, after which the toner was sampled and the tribo-electric properties were measured, according to a method as described in the above mentioned application EP-A-675417, giving q=−7.1 fC, q as defined in said application.

The distance l between the front side of the printhead structure 6 and the sleeve of the magnetic brush assembly 3, was set at 450 μm. The distance between the receiving member support 5 and the back side of the printhead structure 6 (i.e. control electrodes 6*a*) was set to 150 μm and the paper travelled at 1 cm/sec. The shield electrodes 6*b*, 6*c* were grounded : $V_2$=0 V. To the individual control electrodes an (imagewise) voltage $V_3$ between 0 V and −400 V was applied. The receiving member support 5 was connected to a high voltage power supply of +400 V. To the sleeve of the magnetic brush an AC voltage of 600 V at 3.0 kHz was applied, without DC offset.

A photographic image was reproduced with this printhead structure using only the 2 rows of apertures with 170 micron diameter. The image density was controlled by time modulating the voltage $V_3$ applied to the individual control electrodes 6*a*. A second printout was made in which important image edges were accentuated making use of a third and fourth row of apertures with an aperture diameter of only 85 microns. A much better visual quality was obtained from said second printout.

Having described in detail preferred embodiments of the current invention, it will now be apparent to those skilled in the art that numerous modifications can be made therein without departing from the scope of the invention as defined in the following claims.

We claim:

1. An apparatus for direct electro-static printing comprising:

a printhead structure comprising:

a plurality of first apertures;

a plurality of second apertures, said first apertures being at least 50% larger in area than said second apertures; and a plurality of control electrodes on a back side of said printhead structure, an individual one of said control electrodes arranged around each of said first and second apertures; and a toner delivery means facing a front side of said printhead structure for delivering toner particles to said first and second apertures.

2. The apparatus of claim 1, wherein said control electrodes are galvanically isolated from each other.

3. The apparatus of claim 1, wherein said printhead structure further comprises a shield electrode galvanically isolated from said control electrodes, said shield electrode covering a substantial portion of said front side of said printhead structure.

4. The apparatus of claim 1, wherein said first apertures are arranged in a plurality of first aperture rows, and said second apertures are arranged in a plurality of second aperture rows.

5. The apparatus of claim 4, wherein each of said first and second apertures has a center, and wherein a distance between centers of two neighboring second apertures is shorter than a distance between centers of two neighboring first apertures.

6. The apparatus of claim 4, wherein said plurality of first aperture and second aperture rows are parallel to each other.

7. The apparatus of claim 4, wherein said printhead structure further comprises at least one linewise shield electrode for each of said first aperture and second aperture rows, each of said linewise shield electrode being galvanically isolated from said control electrodes and from any other linewise shield electrode, each of said linewise shield electrode covering a substantial portion of a rectangular area surrounding each of said first aperture and second aperture rows on said front side of said printhead structure.

8. The apparatus of claim 1, wherein said printhead structure comprises an insulating plastic substrate.

9. A method for direct electrostatic printing comprising the steps of:

generating multi-level bitmap signals for driving a plurality of control electrodes arranged around a plurality of first and second apertures, said first apertures being at least 50% larger in area than said second apertures, and said multi-level bitmap signals representing a plurality of device pixels, each of said multi-level bitmap signals having more than two levels for each of said device pixels;

analyzing neighboring bitmap signals;

generating high resolution and low resolution signals depending upon variations between said neighboring bitmap signals;

driving said control electrodes arranged around each of said first apertures with said low resolution signals, an individual one of said control electrodes arranged around each of said first apertures;

driving said control electrodes arranged around each of said second apertures with said high resolution signals, an individual one of said control electrodes arranged around each of said second apertures; and transmitting toner from a toner delivery means through said first and second apertures directly onto a receiving member substrate.

10. A method for direct electrostatic printing comprising the steps of:

generating high resolution and low resolution bitmap signals for driving a plurality of control electrodes arranged around a plurality of first and second apertures, said first apertures being at least 50% larger in area than said second apertures;

driving said control electrodes arranged around each of said first apertures with said low resolution signals, an individual one of said control electrodes arranged around each of said first apertures;

driving said control electrodes arranged around each of said second apertures with said high resolution signals, an individual one of said control electrodes arranged around each of said second apertures; and transmitting toner from a toner delivery means through said first and second apertures directly onto said receiving member substrate.

* * * * *

UNITED STATES PATENT AND TRADEMARK OFFICE

CERTIFICATE OF CORRECTION

PATENT NO. : 5,774,158

DATED : Jun. 30, 1998

INVENTOR(S) : Desie, et al

It is certified that error appears in the above-identified patent and that said Letters Patent is hereby corrected as shown below:

Column 1, line 31, "retentive surface is Further on" should read --retentive surface is developed by a suitable material to make the latent image visible. Further on--;

Column 3, line 64, "consistent way densities resolution" should read --consistent way densities that have a small density difference. A device with a high density resolution--;

Column 7, line 61, "transitions will be imaged - at a higher density" should read --sharp transitions will be imaged by the smaller apertures, while the smooth regions will be imaged - at a higher density--;

Column 9, line 22, "distance l" should read --distance ℓ--.

Signed and Sealed this

Seventh Day of September, 1999

*Attest:*

Q. TODD DICKINSON

*Attesting Officer*

*Acting Commissioner of Patents and Trademarks*